US005158359A

United States Patent [19]

Penturelli

[11] Patent Number: 5,158,359

[45] Date of Patent: Oct. 27, 1992

[54] SEALED ILLUMINATION SYSTEM

[76] Inventor: James D. Penturelli, 396 Zion's Church Rd., Shoemakersville, Pa. 19555

[21] Appl. No.: 790,472

[22] Filed: Nov. 12, 1991

[51] Int. Cl.[5] ..... F21S 3/00

[52] U.S. Cl. ..... 362/221; 362/222; 362/224

[58] Field of Search ..... 362/222, 223, 224, 217, 362/221

[56] References Cited

U.S. PATENT DOCUMENTS

| | | | |
|---|---|---|---|
| 2,392,202 | 1/1946 | Tornblom | 362/222 |
| 2,774,947 | 12/1956 | Frensch | 362/217 |
| 4,156,893 | 5/1979 | Baake | 362/222 |
| 4,229,780 | 10/1980 | Nelson | 362/222 |
| 4,435,744 | 3/1984 | Russo | 362/219 |
| 4,547,839 | 10/1985 | Ripley | 362/216 |
| 4,712,165 | 12/1987 | Cetrone | 362/222 |
| 4,851,972 | 7/1989 | Altman | 362/267 |

FOREIGN PATENT DOCUMENTS

| | | | |
|---|---|---|---|
| 1186550 | 2/1965 | Fed. Rep. of Germany | 362/217 |

*Primary Examiner*—Carroll B. Dority

*Attorney, Agent, or Firm*—Eckert Seamans Cherin & Mellott

[57] ABSTRACT

An improved illumination system has a lamp encased in a translucent tube with open ends coupled to endcaps via seals disposed circumferentially around the open ends and securing the tube to the endcaps in removable engagement. The seals are compressed between the tube and a securing nut or collar, forming a watertight seal. The endcaps include electrical connectors for providing electrical power to the encased lamp, coupled to electrical circuitry such as a ballast transformer encased in a sealed housing, via conductors in sealed conduits leading to the endcaps. The illumination system can have two or more lamps in respective transparent tubes, in parallel relation with support tubes and conduits leading from the circuitry to the endcaps. Preferably, end portions of the conduits and tubes are angled, for example at 45 degrees with respect to a center portion, for positioning the transparent tubes at a plane displaced from that of the housing. Fixtures according to the invention can be cascaded in sealed arrays by appropriate tubing, for example along a factory ceiling wherein the fixtures are arranged in line and connected via polyvinyl chloride pipes.

19 Claims, 7 Drawing Sheets

SEALED ILLUMINATION SYSTEM

BACKGROUND OF THE INVENTION

1. Field of the Invention

This invention relates to the field of illumination systems and more specifically to a sealed lighting system wherein the entire lighting system including lighting tubes, ballast and wiring is completely sealed from the surrounding environment.

2. Prior Art

Sealed lighting systems are widely used in harsh or hazardous environments where the lighting systems are exposed to high levels of moisture, corrosive or explosive compounds. For example, sealed lighting systems are often used in marine environments wherein the high humidity and salt content of the ambient environment easily corrodes electrical components. Similarly, in many industrial environments, airborne explosive compounds may be easily ignited by electrical sparks. Accordingly, sealed lighting fixtures are employed to prevent interaction between electrical components and the surrounding environment. Finally, sealed lighting fixtures are often used in hostile environments wherein lighting elements may be prone to fractures due to mechanical impacts.

One type of sealed lighting fixture is disclosed in U.S. Pat. No. 4,435,744—Russo. This reference discloses a fluorescent light fixture sealed from an environment in which explosive vapors are present to prevent sparks from the fixture from detonating the vapors. The apparatus comprises a plurality of globes into which fluorescent tubes are inserted, wherein the respective globes are bolted into a fixture at either end. The apparatus incorporates spring biased endcaps to facilitate the removal of inoperative fluorescent tubes. Wiring for providing power to the fluorescent lamps is routed to the fluorescent lamps through channels formed in the end attachment pieces. This system has several problems. In order to replace a lamp, the entire unit including the globe and end pieces must be unbolted from the fixture. While unbolting the endcaps, undesirable stress may be placed on the associated wiring, thus affecting the reliability of the system. Furthermore, the apparatus of Russo is constructed of either aluminum alloy, brass or brass alloy. Accordingly, this apparatus is prone to corrosion in many environments.

Another type of sealed lighting system is described in U.S. Pat. No. 4,851,972—Altman. This system incorporates a transparent tube of plastic polymeric material. Within the tube are a series of miniature lamps. The ends of the tube, which contain the electrical connectors, are sealed with a hardened thermoplastic potting compound. Moisture-free gas is injected into the tube through a hole in the tube wall. The existing air in the tube is forced out through another hole in the tube wall. The holes are then sealed to trap the moisture-free gas within the tube and prevent moisture from entering therein. While this system provides a moisture resistant lighting structure, it has several deficiencies. Since miniature lamps are used in the structure, limited light is produced by the structure. Furthermore, since the structure is sealed with thermoplastic material, the entire structure must be discarded when the lamps burn out.

Still another type of sealed lighting fixture is described in U.S. Pat. No. 4,547,839—Ripley et al. This reference discloses an outdoor lighting fixture for a circular fluorescent lamp. This device comprises a circular base containing a socket into which the lamp is inserted. The base contains a lip wherein a hollow transparent casing of cylindrical shape is placed over the base to protect the lamp, the casing being seated around the lip on the base. The lamp thus resides within a closed protected casing which is sealed from environmental factors. While this apparatus provides environmental protection for a circular fluorescent lamp, no means are disclosed for protecting associated electrical circuitry for powering the lamp.

From the foregoing, no method or apparatus is known which provides environmental protection for both a lamp and associated electrical circuitry, in a sealed assembly which is constructed with non-corrosive materials, and which is easily opened for servicing without the need for disassembling the structure or disturbing the internal wiring of the apparatus.

SUMMARY OF THE INVENTION

In summary, the present invention comprises an improved lighting sealed lighting system wherein all components of the lighting system are sealed from the environment. The present invention includes a translucent tube for encasing a lamp, wherein the translucent tube has open ends, and a plurality of annular seal members are disposed concentrically about each open end. A plurality of endcaps are coupled to each end of the translucent tube and means are provided for securing the translucent tube to the endcaps in removable engagement. When attached, the means for securing compresses the seal members between the translucent tube and the means for securing, thus forming a watertight seal. Electrical connectors are disposed within the endcaps and electrical circuitry for powering and controlling said lamp is encased in a sealed housing and coupled to the electrical connectors means with electrical wiring. A sealed conduit is coupled between the sealed housing and the respective endcaps for supporting the translucent tube and the endcaps, and for encasing the electrical wiring. The apparatus of the present invention is constructed entirely with non-corrosive materials wherein the translucent tube is preferably constructed of polycarbonate, the seal members are preferably constructed with synthetic rubber and the remaining components are preferably constructed with polyvinyl chloride tubing.

Accordingly, it is an object of the present invention to provide an improved lighting system which is completely sealed from a surrounding environment.

It is another object of the present invention to provide an improved lighting system which is resistant to exposure to moisture and corrosive substances.

It is still another object of the present invention to provide an improved lighting system which is constructed of non-corrosive, readily available materials.

It is still another object of the present invention to provide a sealed lighting fixture which may be opened for lamp replacement and servicing without the need for special tools.

It is still another object of the present invention to provide a sealed lighting assembly which is readily adaptable to a wide variety of lamp sizes.

BRIEF DESCRIPTION OF THE DRAWINGS

These and other objects will be apparent to a person of ordinary skill through the detailed description of the invention below and the accompanying drawings in which.

DETAILED DESCRIPTION OF THE PRESENT INVENTION

Figure 1:
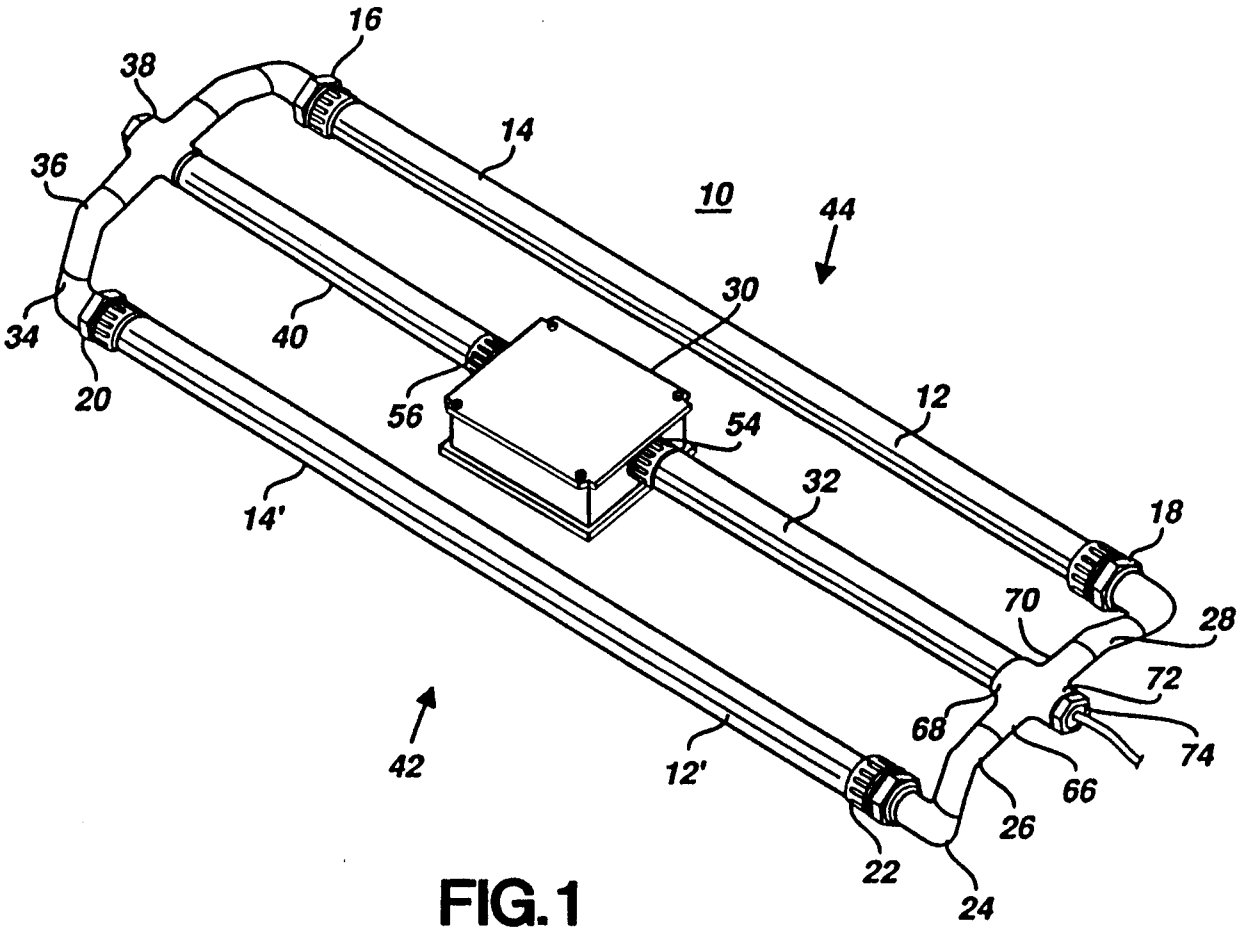
FIG. 1 is a view in perspective of an overhead lighting fixture constructed in accordance with the principles of the present invention.
Figure 2:
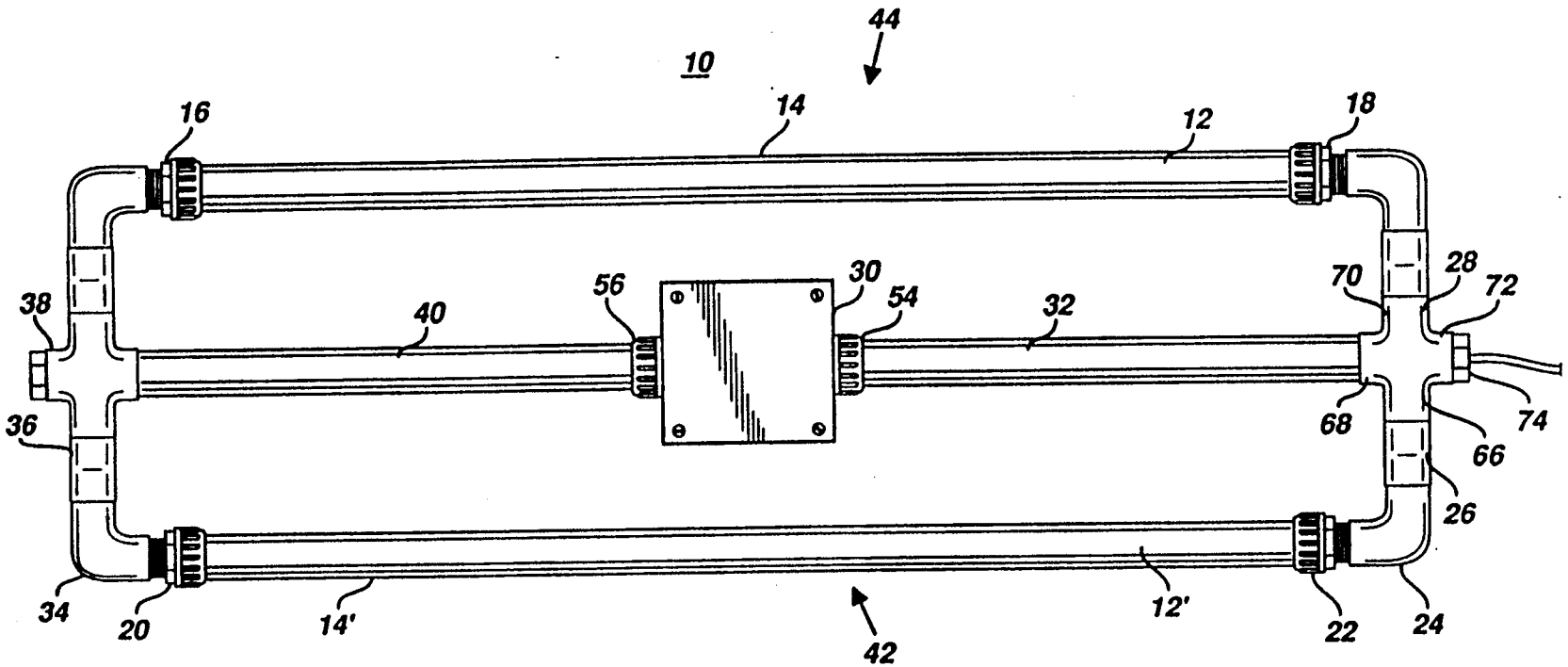
FIG. 2 is a top view of the overhead lighting fixture of FIG. 1.

The present invention provides an improved lighting system which is substantially immune from the surrounding environmental effects such as humidity and air-borne corrosive elements. Referring now to FIGS. 1 and 2, the improved lighting system 10 provides a sealed operating environment for fluorescent lamps 12, 12' which are encased in transparent tubes 14, 14'. The transparent tubes 14, 14' are coupled in air-tight engagement with endcaps 16, 18 and 20, 22, respectively, wherein the endcaps also support electrical connectors for providing power to fluorescent lamps 12, 12'.

The respective endcaps 16, 18 and 20, 22 are supported in an operating position by an assembly formed with a plurality of tubular members. For example, endcap 22 is coupled to 90 degree elbow member 24 which is in turn coupled to a coupling member 26 having a 45 degree bend in the plane perpendicular to the plane of the 90 degree bend of elbow member 24. Coupling member 26 is further coupled to multi-junction member 28. Multi-junction member 28 provides a junction between the respective lighting sections of apparatus 10 as well as a centrally supported ballast enclosure 30 which is coupled to junction member 28 via conduit member 32 and coupling member 54.

The opposite side of apparatus 10 incorporates a similar structure wherein endcap 20 is coupled to elbow member 34; elbow member 34 is coupled to coupling member 36; coupling member 36 is coupled to junction member 38; and junction member 38 is coupled to ballast housing 30 via conduit member 40 and coupling member 56.

The apparatus 10 comprises two identical illumination sections 42, 44 although the principles of the present invention may be applied to systems having any number of illumination sections. Accordingly, only illumination section 42 is discussed in detail herein.

Each of the respective elbow, coupling, conduit and junction members are preferably fabricated with polyvinyl chloride (PVC) which is substantially immune from the effects of moisture or humidity. The respective elbow, coupling, conduit and junction members are preferably tubular, having hollow interior cavities to facilitate the routing of wiring therein. The transparent tubes 14, 14' are preferably fabricated of clear polycarbonate such as LEXAN which provides for the efficient transfer of light while also providing excellent protection for encased lamps 12, 12', from environmental as well as mechanical damage.

Figure 3:
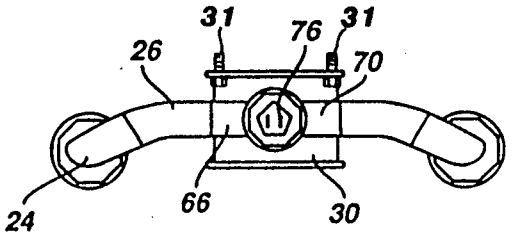
FIG. 3 is an end view of the overhead lighting fixture of FIGS. 1 and 2.
Figure 4:
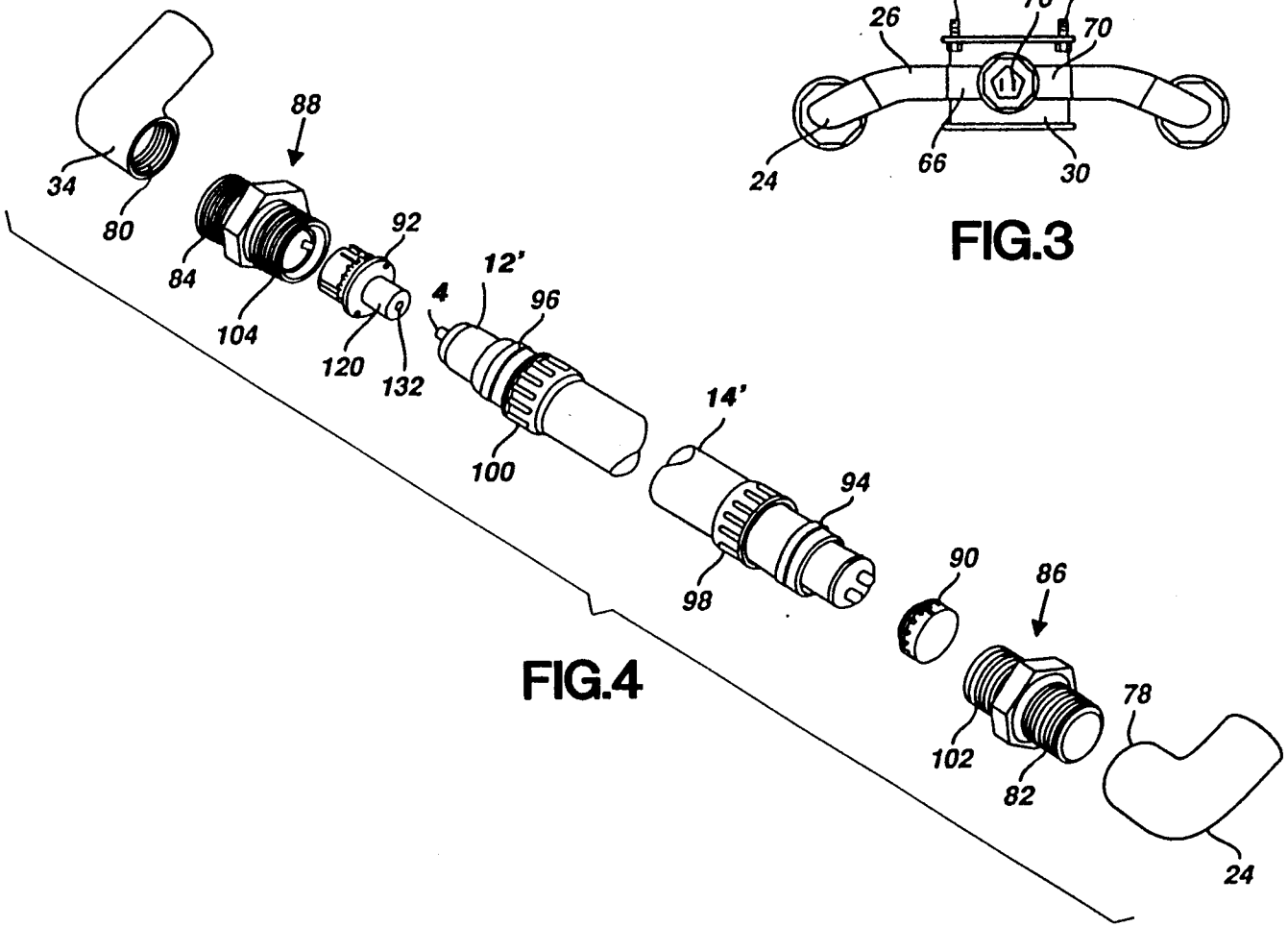
FIG. 4 is an exploded view in perspective detailing the attachment of the lighting assembly to associated endcap members.

The apparatus 10 may easily be constructed of readily available materials and without the need for special tools. For example, ballast housing 30 comprises a conventional fiberglass component housing having a plurality of threaded annular orifices 46, 48 (FIG. 8) disposed in opposing faces 50, 52. A plurality of conventional PVC coupling members 54, 56 engage threaded annular orifices 46, 48, wherein coupling members 54, 56 each include a threaded exterior portion 58, 60 for engaging threaded annular orifices 46, 48, respectively, as well as conventional non-threaded socket portions 62, 64 for receiving conduit members 32, 40, respectively, in a male/female arrangement. Conduit members 32, 40 may be joined to socket portions 62, 64 with a conventional PVC adhesive. The housing 30 can include mounting means for attachment to a structure, such as screws 31, shown in FIG. 3.

Junction members 28, 38 may be substantially identical. Accordingly, only junction member 28 is discussed in detail herein. Junction member 28 comprises orthogonally oriented socket portions 66, 68, 70, and 72, (FIG. 2) each of which is adapted to receive male portions of an associated conduit, coupling or terminating member. Specifically, socket portion 66 is adapted to receive coupling member 26; socket portion 68 is adapted to receive conduit member 32; and socket member 70 is adapted to receive a coupling member attached to illumination section 44. Socket member 72 may be fitted with a termination plug 74 which is configured with an electrical socket 76 (FIG. 3) which provides electrical power for apparatus 10. In the alternative, socket member 72 may be joined to a coupling member 77 (FIG. 9) for cascading multiple sections of apparatus 10. Each of the respective conduit, coupling and plug members may be joined to junction members 28, 38 with conventional PVC adhesive. Similarly, the respective elbow members 24, 34 may be joined to coupling members 26, 36 with conventional male/female interfaces and PVC adhesive.

The detailed construction of illumination section 42 is discussed in more conjunction with FIGS. 4 and 5A-5C. Each of the respective elbow members 24, 34 are coupled to coupling members 26, 36 with conventional male/female couplings joined with PVC adhesive. The opposite ends of elbow members 24, 34 incorporate threaded sockets 78, 80 adapted to receive threaded stems 82, 84 of coupling members 86, 88, respectively. Spring biased electrical connectors 90, 92 are disposed coaxially within coupling members 86, 88 for receiving electrical contacts of lamp member 12'. Transparent tube 14' is secured to coupling members 86, 88 with compressible retaining rings 94, 96 and retaining caps 98, 100 which engage threaded portions 102, 104 of coupling members 86, 88, respectively.

Figure 5A:
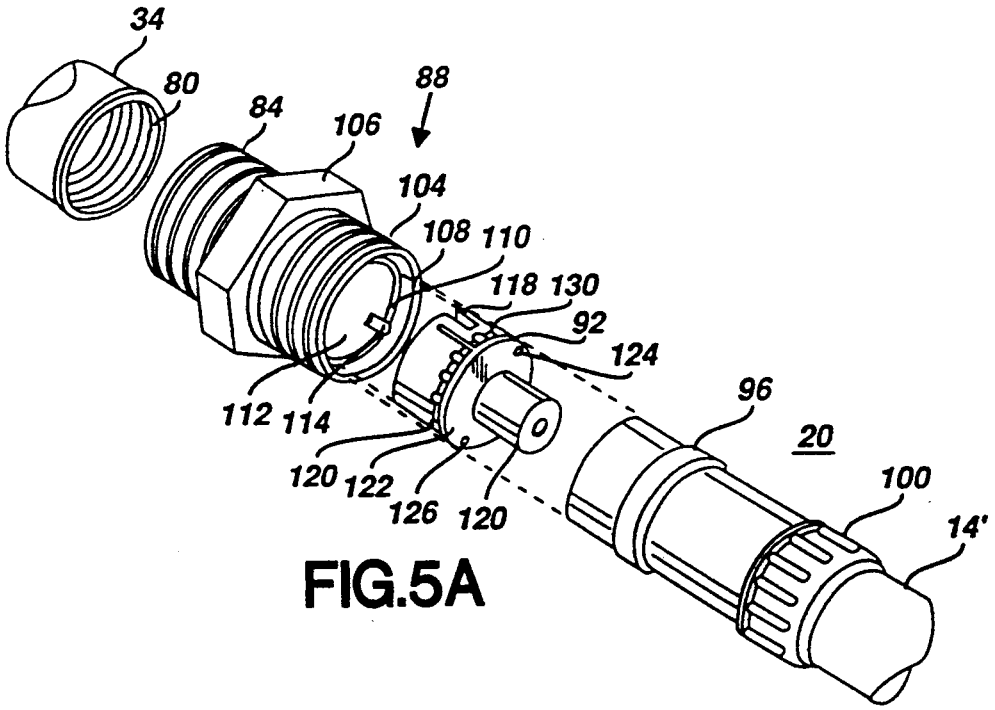
FIG. 5A is a more detailed exploded view showing the construction of a single endcap member.
Figure 5B:
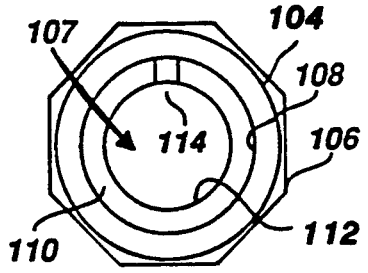
FIG. 5B is a top view of the coupling member of FIG. 5A.
Figure 5C:
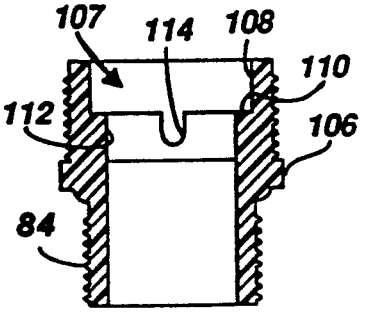
FIG. 5C is a cutaway view of the coupling member of FIG. 5A.
Figure 6:
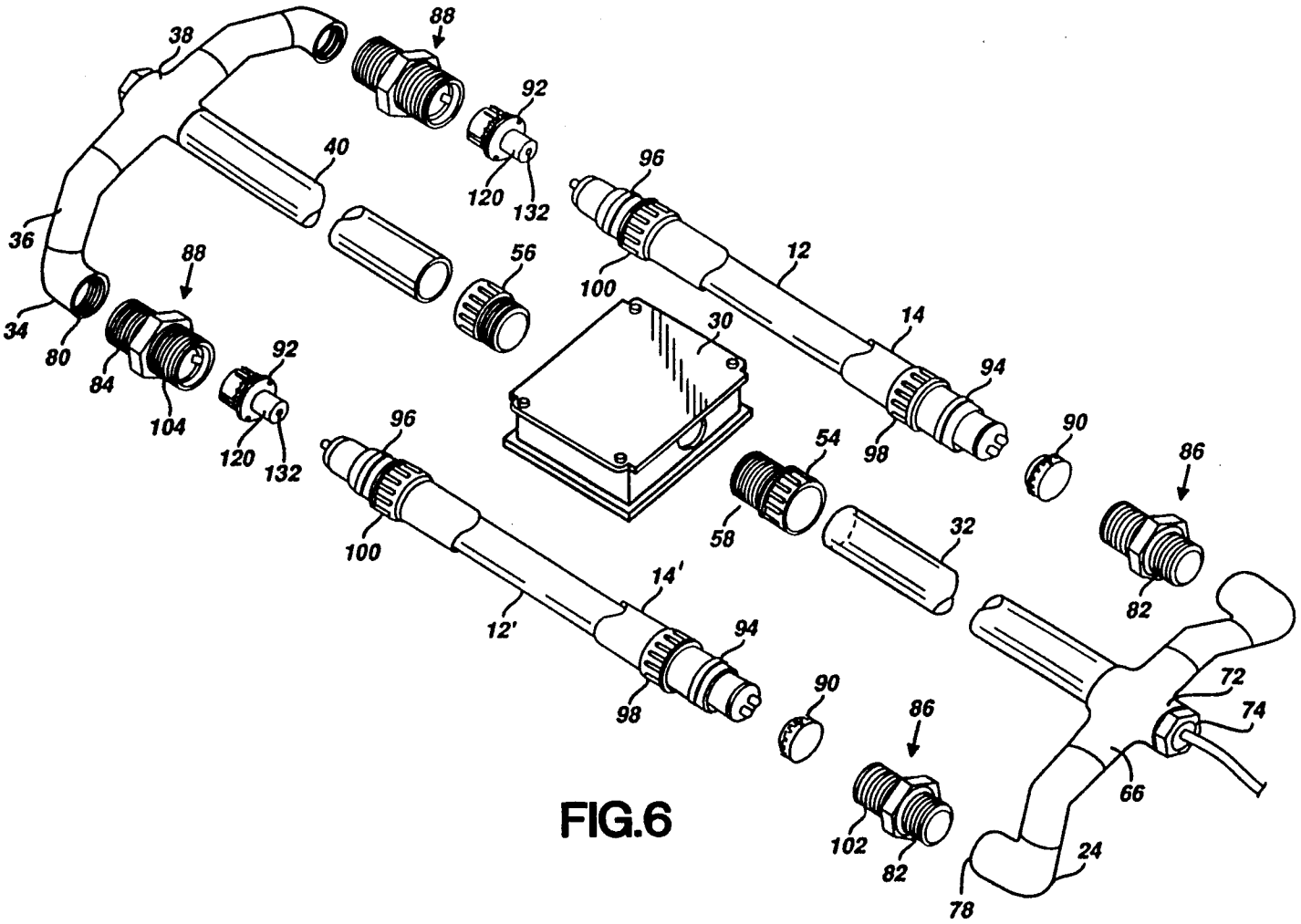
FIG. 6 is an exploded view in perspective of a single lighting unit constructed in accordance with the principles of the present invention.

The specific construction of the respective endcaps (e.g. endcaps 20, 22) is described in detail in conjunction with FIGS. 5A-5C. The respective endcaps 20, 22 comprise substantially identical assemblies, with the exception that elbow members 24, 34 comprise mirror image pairs. Accordingly, only the assembly of endcap 20 is discussed in detail herein. End cap 20 includes coupling member 88 having a threaded portion 84 which engages threaded orifice 80 of elbow member 34, also having threaded portion 104 for engaging retaining cap 100. Coupling member 88 further includes an exterior wrenching surface 106 to facilitate tightening of coupling member 88 within elbow member 34.

Electrical connector 92 is disposed within coupling member 88 wherein coupling member 88 includes an internal recess 107 for receiving a portion of electrical connector 92. Internal recess 107 is formed by the interior portion of sidewall 108 as well as offset annular ledge 110 formed integrally with sidewall 108. Annular wall 112 is disposed coaxially with sidewall 108 and is terminated by annular ledge 110. Annular wall 112 includes a notched portion 114 for receiving alignment tab 116 (FIG. 7A) of electrical connector 92.

Figure 7A:
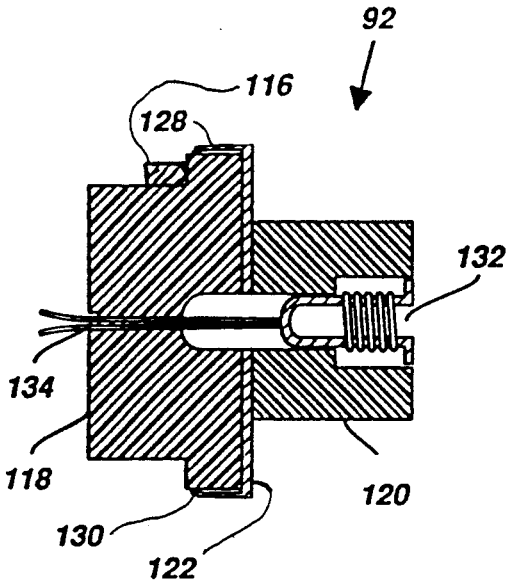
FIG. 7A is a cross-sectional view of a spring loaded connector used to provide power to the lamps of the present invention.
Figure 7B:
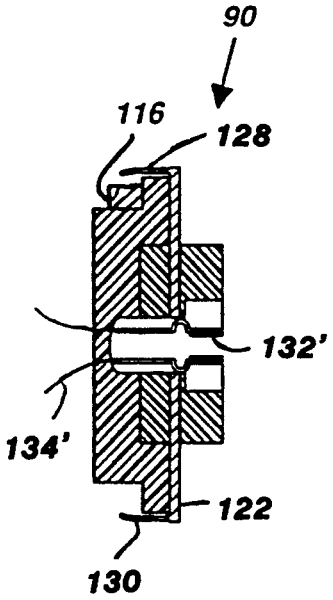
FIG. 7B is a cross-sectional view of another spring loaded connector used to provide power to the lamps of the present invention.

Referring now to FIGS. 5A, 7A, and 7B, electrical connector 92 comprises a body portion 118 which supports terminal body 120. Terminal body 120 is secured to body portion 118 with annular flange 122 wherein annular flange is attached to body portion 118 with rivets 124, 126. A plurality of leaf spring elements (e.g. leaf spring elements 128, 130) are disposed concentrically about the periphery of body portion 118 wherein the respective leaf spring members frictionally engage annular wall 112 when connector 92 is inserted in coupling member 88. Thus, when electrical connector 92 is inserted in coupling member 88, it is held securely in position by the leaf spring members 128, 130 engaging annular wall 112 and by annular flange 122 abutting against annular ledge 110. As will be further discussed below, when the respective lamps are installed in apparatus 10, the force exerted by the respective lamps against the respective electrical connectors also tends to hold the respective electrical connectors in place. Electrical connector 90 incorporates the same basic structure as electrical connector 92 but is adapted to receive an opposite end of a fluorescent tube. Accordingly, elements which provide similar functions are identified by the same reference number in FIGS. 7A and 7B.

Referring to FIG. 7A and 7B, within each respective electrical connector, spring biased terminals 132, 132' are centrally disposed for contacting the electrical connections of the lamps used in the apparatus 10. Input terminals 134, 134' are disposed on one surface of body portion 118 to provide power to the respective terminals 132, 132'. The respective electrical connectors (e.g. electrical connectors 92, 90) are of the conventional type used for fluorescent lamps and those skilled in the art will appreciate that these connectors may be adapted for a variety of lamp types. In the preferred practice of the invention, polarized electrical connectors are employed for accommodating opposing ends of a conventional fluorescent lamp. Those skilled in the art will also appreciate that the principles of the present invention may be applied to lamps having a variety of sizes and output levels by merely adjusting the size of the respective components of apparatus 10.

Referring again to FIGS. 4 and 5A-5C, recess 107 is also adapted to receive one end of transparent tube 14' which is secured in place with compressible retaining ring 96 and retaining cap 100. Specifically, retaining ring 96 is disposed concentrically about transparent tube 14' in firm engagement therewith. Transparent tube 14' and retaining ring 96 are inserted into recess 107 wherein retaining ring 96 rests against annular ledge 110 and the interior surface annular wall 108. When retaining cap 100 engages threaded portion 104 it is rotated in threaded engagement. As retaining cap 100 is rotated, it compresses retaining ring 96, thus forming a secure junction for holding transparent tube 14' in position. An identical structure is used for securing each end of the respective transparent tubes 14, 14' of apparatus 10 thus providing for the easy removal and attachment of the respective transparent tubes for installation and replacement of the respective lamps 12, 12'.

Figure 8:
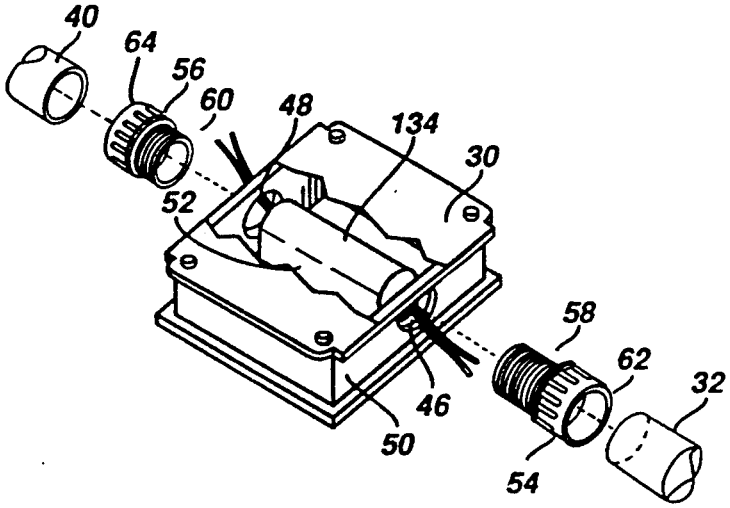
FIG. 8 is another view in perspective of the overhead lighting fixture of FIG. 1 showing the internal components of the ballast housing.

The apparatus 10 provides a sealed environment for the respective fluorescent lamps 12, 12' as well as the associated electrical components and wiring. A ballast member 134 is mounted in housing 30 with conventional means (FIG. 8). Wiring for the respective lamps is routed through the hollow interior portions of the respective conduit, junction, elbow and coupling members to the associated electrical connectors. Power to the system may be provided through termination plug 74 and electrical socket 76 which is coupled with appropriate wiring to ballast member 134.

It is also possible to construct the apparatus 10 according to the invention without the transparent tubes 14, 14'. In this embodiment, ends of the fluorescent lamps 12, 12' are sealed in the respective endcaps 16, 18, 20 and 22. Components of the endcaps are sized as required to provide air tight sealing around a circumference of the fluorescent lamps and to provide mating engagement of threaded joints. For example, referring again to FIGS. 4 and 5A-5C, an inner diameter of the seal 96 is reduced for sealing directly on the fluorescent lamp 12' adjacent to terminal end 4. An outer diameter of the seal 96 and the size of the retaining cap 100 are reduced accordingly. In practice, applicant has utilized a standard 1 ¼ inch diameter retaining cap 100 for the embodiment without the transparent tubes as opposed to a 1 ½ inch diameter retaining cap 100 for the embodiment with the transparent tubes. Threaded portion 104 of the coupling member 88 is reduced in size as required for threaded engagement with the retaining cap 100. For standard size couplings, reduction in size of the threaded portion 104 results in a reduction in size of the recess 107. The electrical connector 92 may be reduced in size if required to fit within the smaller recess 107. Alternatively, applicant has increased the diameter of the sidewall 88 and the annular wall 112 in the coupling 88 having reduced size threaded portion 104 in order to accommodate the electrical connector 92 which has not been reduced in size. In the embodiment without the transparent tubes, a guard such as, for example, a metal wire cage may be provided around the fluorescent lamps 12, 12' to protect against accidental breakage of the lamps.

Figure 9:
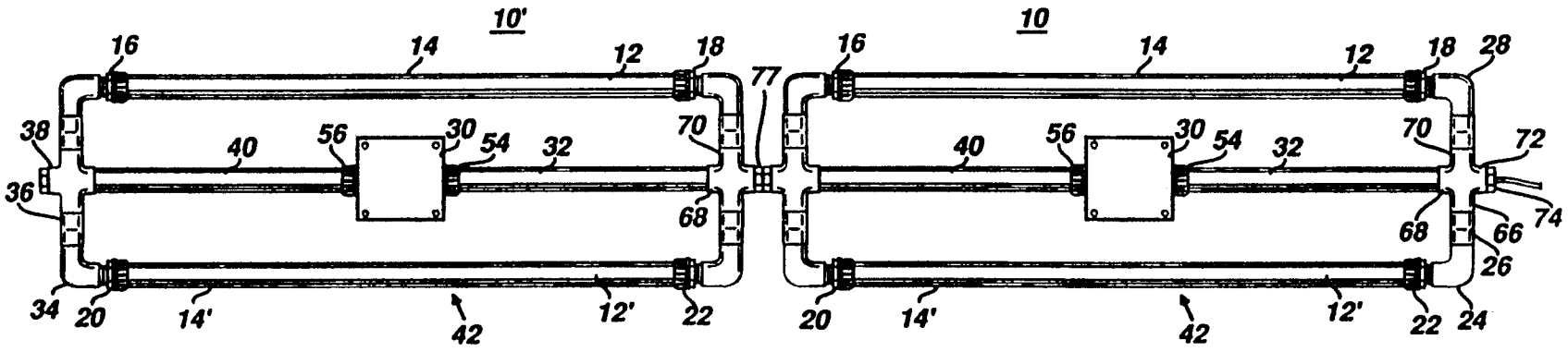
FIG. 9 is a top view of a bank of overhead lighting units constructed in accordance with the teachings of the present invention.

Referring now to FIG. 9, the apparatus 10 may be used as a single fixture or cascaded in multiple sections to create lighting systems of virtually any length. For example, as shown in FIG. 9, lighting sections 10, 10' may be joined with coupling member 77 to a cascaded lighting assembly. In some embodiments, the ballast housing 30 may be eliminated from some cascaded sections so that the respective lighting sections operate from a single ballast section. In summary, an improved sealed lighting system has been described. The improved lighting system of the present invention is easily constructed without the need for special tools or materials and provides a system which is largely immune from environmental or mechanical degradation. Accordingly, other uses and modifications of the present invention will be readily apparent to persons of ordinary skill. All of such uses and modifications are intended to fall within the scope of the appended claims.

I claim:

1. An improved lighting system, comprising:

a lamp for providing a source of illumination;

a translucent tube for encasing said lamp, said translucent tube having open ends;

a plurality of endcaps coupled to said translucent tube;

seal members disposed circumferentially around said open ends of said translucent tube;

means for securing said translucent tube to said endcaps in removable engagement, said means for securing comprising compressing said seal members between said translucent tube and said means for securing thus forming a watertight seal;

electrical connection means disposed within said endcaps, said electrical connection means for providing electrical power to said encased lamp;

electrical circuitry for powering and controlling said lamp, said electrical circuitry encased in a sealed housing and coupled to said electrical connection means with electrical wiring; and sealed conduit means coupled between said sealed housing and said endcaps for supporting said translucent tube and said endcaps, and for encasing said electrical wiring.

2. The apparatus of claim 1, wherein said sealed housing further includes mounting means for attaching said sealed housing to a structure.

3. The apparatus of claim 1, wherein said endcaps and said sealed conduit means are fabricated with polyvinyl chloride material.

4. The apparatus of claim 1, wherein said electrical connection means are disposed in removable engagement within said endcaps.

5. The apparatus of claim 1, wherein said endcaps and said electrical connection means are configured with complementary keying surfaces which prevent the rotation of said electrical connection means within said endcaps.

6. The apparatus of claim 1, wherein said electrical connection means are spring biased to provide a positive electrical connection with said encased lamp.

7. The apparatus of claim 1, wherein said transparent tubes are fabricated from polycarbonate.

8. An improved illumination system, comprising:

a first and second lamp for providing a source of illumination;

first and second transparent tubes for encasing said first and second lamps, respectively, each of said transparent tubes having open ends;

a plurality of tubular endcaps having inlet and outlet openings, wherein the inlet openings of said plurality of endcaps are coupled to said open ends of said transparent tubes;

a plurality of seal members disposed circumferentially about said open ends of said first and second transparent tubes, said seal members adapted to compress between said inlet openings of said endcaps and said transparent tubes to form a watertight seal;

a plurality of electrical connectors disposed within said inlet openings of said endcaps, said plurality of electrical connectors for providing electrical power to said first and second lamps;

electrical circuitry means for powering and controlling said first and second lamps, said electrical circuitry means disposed within a sealed housing and coupled to said first and second lamps with electrical wiring;

first and second coupling conduit means coupled between said outlet openings of said endcaps disposed at each end of said first and second transparent tubes, respectively; and first and second support conduits coupled between said sealed housing and said first and second coupling conduits, respectively, said first and second support conduits and said first and second coupling conduits for enclosing said electrical wiring and for supporting said transparent tubes and said lamps.

9. The apparatus of claim 8, wherein said first and second support conduits are disposed in parallel relation with respect to said plurality of support tubes.

10. The apparatus of claim 8, wherein said first and second coupling conduits are disposed in perpendicular relation with respect to said support conduits, and further wherein said first and second coupling conduits include center and end portions, wherein said end portions are angled with respect to said center portion.

11. The apparatus of claim 10, wherein said end portions are angled at 45 degrees with respect to said center portion.

12. The apparatus of claim 8, further including means for connecting multiple of said improved illumination systems to form a cascaded illumination system.

13. The apparatus of claim 8, wherein said sealed housing further includes mounting means for attaching said sealed housing to a structure.

14. The apparatus of claim 8, wherein said endcaps and said first and second coupling conduit means and said first and second support conduit means are fabricated with polyvinyl chloride material.

15. The apparatus of claim 8, wherein said electrical connection means are disposed in removable engagement within said endcaps.

16. The apparatus of claim 8, wherein said endcaps and said electrical connection means are configured with complementary keying surfaces which prevent the rotation of said electrical connection means within said endcaps.

17. The apparatus of claim 8, wherein said electrical connection means are spring biased to provide a positive electrical connection with said encased lamp.

18. The apparatus of claim 8, wherein said transparent tubes are fabricated from LEXAN.

19. The apparatus of claim 8, wherein said first and second support conduits are coupled to said sealed housing in sealed engagement and further wherein said first and second support conduits are coupled to said first and second coupling conduits in sealed engagement.

* * * * *